US005242112A

United States Patent [19]

Dunn et al.

[11] Patent Number: 5,242,112

[45] Date of Patent: Sep. 7, 1993

[54] SWING CONNECTOR FOR SPRINKLER

[75] Inventors: Richard M. Dunn, Encinitas; Sean A. O'Neill, Escandido, both of Calif.

[73] Assignee: Hunter Industries, San Marcos, Calif.

[21] Appl. No.: 916,510

[22] Filed: Jul. 20, 1992

[51] Int. Cl.[5] ..... B05B 15/08

[52] U.S. Cl. ..... 239/203; 239/201; 239/207; 239/587.2; 239/588; 285/181; 285/272

[58] Field of Search ..... 239/201, 203, 204, 205, 239/207, 587.2, 588; 138/178; 285/181, 168, 239, 240, 272

[56] References Cited

U.S. PATENT DOCUMENTS

| | | | |
|---|---|---|---|
| 1,337,744 | 4/1920 | Ballerstedt | 239/203 |
| 1,710,888 | 4/1929 | Munz | 239/204 |
| 3,684,179 | 8/1972 | Fischer et al. | 239/203 |
| 3,759,445 | 9/1973 | King | 239/588 X |
| 4,037,861 | 7/1977 | Medney | 285/181 X |
| 4,314,717 | 2/1982 | Bjurman | 239/588 X |
| 4,410,281 | 10/1983 | Crookes | 138/178 X |
| 4,906,131 | 3/1990 | Savoka | 239/201 X |
| 4,998,755 | 3/1991 | Reeder | 285/181 |
| 5,039,011 | 8/1991 | Parker | 239/201 X |
| 5,040,729 | 8/1991 | Carrozza | 239/207 X |

OTHER PUBLICATIONS

Toro 78, undated.
Toro 76, undated.
Toro Funny Pipe & Fittings, undated.
Rain Bind 1800-Ext. Plastic Extension, undated.
King Brothers Industries, undated.
Dura Plastic Products, Inc., May, 1990.

*Primary Examiner*—Andres Kashnikow
*Assistant Examiner*—William Grant
*Attorney, Agent, or Firm*—Baker, Maxham, Jester & Meador

[57] ABSTRACT

A swing connector assembly for connecting a sprinkler unit to a supply line includes an elongated conduit having a pair of swivel elbows connected to it by barbed fittings at each end thereof providing for three degrees of orthogonal rotation for enabling unlimited positioning of the sprinkler unit within the length of the conduit.

20 Claims, 2 Drawing Sheets 48
50
32
36
54
28
52
40
44
46
28
32
36
28
38
34
26
26
30
42

30
42

SWING CONNECTOR FOR SPRINKLER

BACKGROUND OF THE INVENTION

The present invention relates to sprinkler systems and pertains particularly to swing connectors for pop-up sprinkler systems.

Sprinkler units which retract into a housing in the ground when not in use, and which pop-up or extend from a housing in the ground when water pressure is supplied thereto, are widely used in both residential and commercial applications. These sprinkler units are typically mounted so that the top is substantially even with the surrounding surface of the ground when not in use. The nozzle unit extends upward above the surface of the ground when in use and retracts when not in use.

In the past, sprinkler units were mounted on a short riser on top of the supply line so that the top of the sprinkler housing was even with the surrounding ground surface This usually required several different lengths of risers to adjust the sprinkler unit to the proper height, because of varying terrain surface and depth of the supply line. This is usually an acceptable approach in most cases when the sprinkler unit is short enough to accommodate shallow buried supply lines, and adequate care was taken by the installer. However, longer stroke sprinkler units and many conditions require some other form of accommodation. The prior art approach frequently left the sprinkler unit protruding and unsafe or buried and inoperative.

In recent years, some installers have begun to use offset connector lines to accommodate the sprinkler unit to grade. The offset connector lines were made up on the spot from fittings, such as a short length of pipe and elbows. The elbows and fittings were usually threaded or solvent welded to the supply lines, and extensions. The solvent welded connections could not accommodate any adjustment after installation. The threaded connections could accommodate some minor adjustment, but with a risk of partially unscrewing and leakage. Other approaches use an elongated flexible line to accommodate some variation on the height of the sprinkler. This approach is time consuming, labor intensive and expensive.

Another approach to accommodate different depths was to construct the sprinkler housing with both end and side inlets. This approach is unsatisfactory, because it is expensive and enables accumulation of debris in the bottom of the sprinkler housing. These two approaches have a number of drawbacks, including costs due to parts and increased labor.

It is, therefore, desirable that an improved connector assembly for pop-up sprinklers be available that can accommodate to sprinkle to varying depth of a supply line.

SUMMARY AND OBJECTS OF THE INVENTION

It is the primary object of the present invention to provide an improved connector assembly for sprinkler units.

In accordance with a primary aspect of the present invention, a connector for a sprinkler unit comprises an elongated central conduit, with an elbow rotatably connected to each end thereof, and a connector member rotatably connected to an outer end of the elbows for enabling rotation about an axis orthogonal to the axis of the central conduit.

BRIEF DESCRIPTION OF THE DRAWING

The above and other objects and advantages of the present invention will become apparent from the following description when read in conjunction with the accompanying drawing wherein.

DETAILED DESCRIPTION OF A PREFERRED EMBODIMENT

Figure 1:
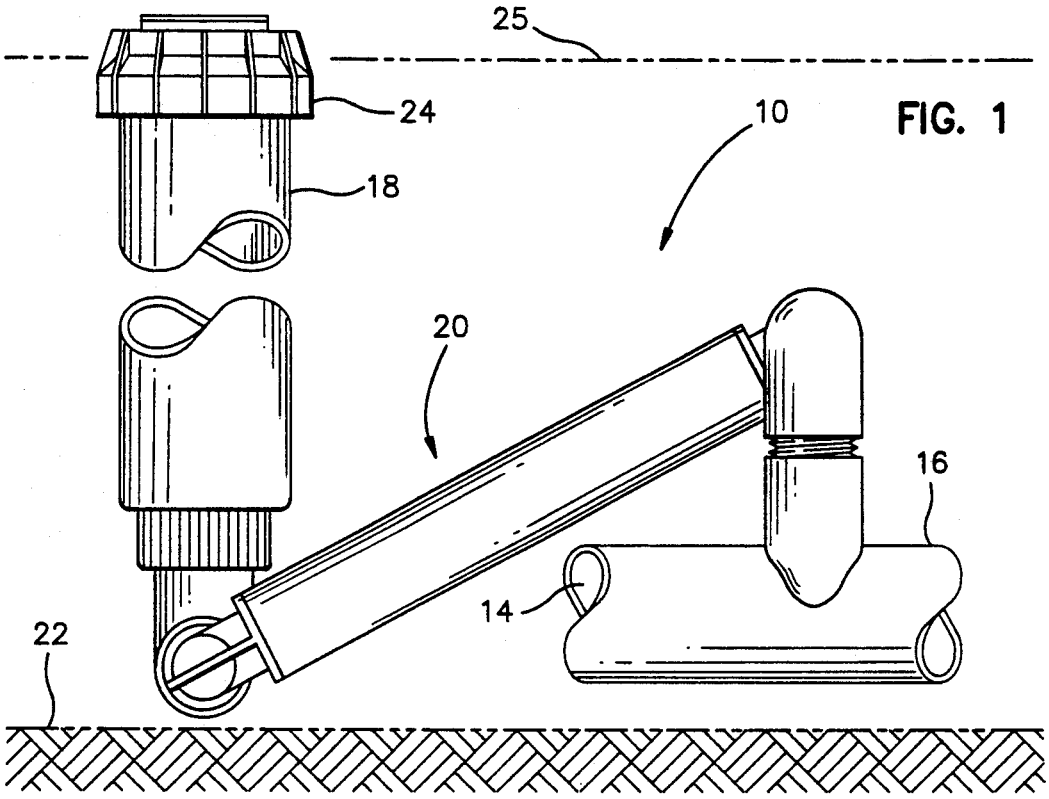
FIG. 1 a side elevation view illustrating a sprinkler installation embodying a sprinkler unit swing connector according to the invention.

Referring to FIG. 1 of the drawings, there is illustrated a side elevational view of a typical sprinkler installation embodying a preferred embodiment of the present invention, designated generally by the numeral 10. In the illustration, a trench 12 is formed having a bottom 14 on which rests a water supply line 16. A pop-up sprinkler unit 18 having a height greater than that of the depth of the trench 12 is connected to the supply line 16 by means of a swivel or swing connector assembly in accordance with the invention, and designated generally by the numeral 20. In order to accommodate the height of the sprinkler 18, an excavation is made adjacent the trench 12, forming a pocket or recess having a floor 22 for accommodating the lower end of the sprinkler unit 18 in a position adjacent the trench 12 and supply line 16. A swing connector in accordance with the invention connects the sprinkler unit 18 to the supply line, and enables the sprinkler unit to be manipulated and swung about the many axes of the swing unit to position the top 24 of the sprinkler unit such that it is substantially even or flush with the surrounding ground surface 25.

Figure 2:
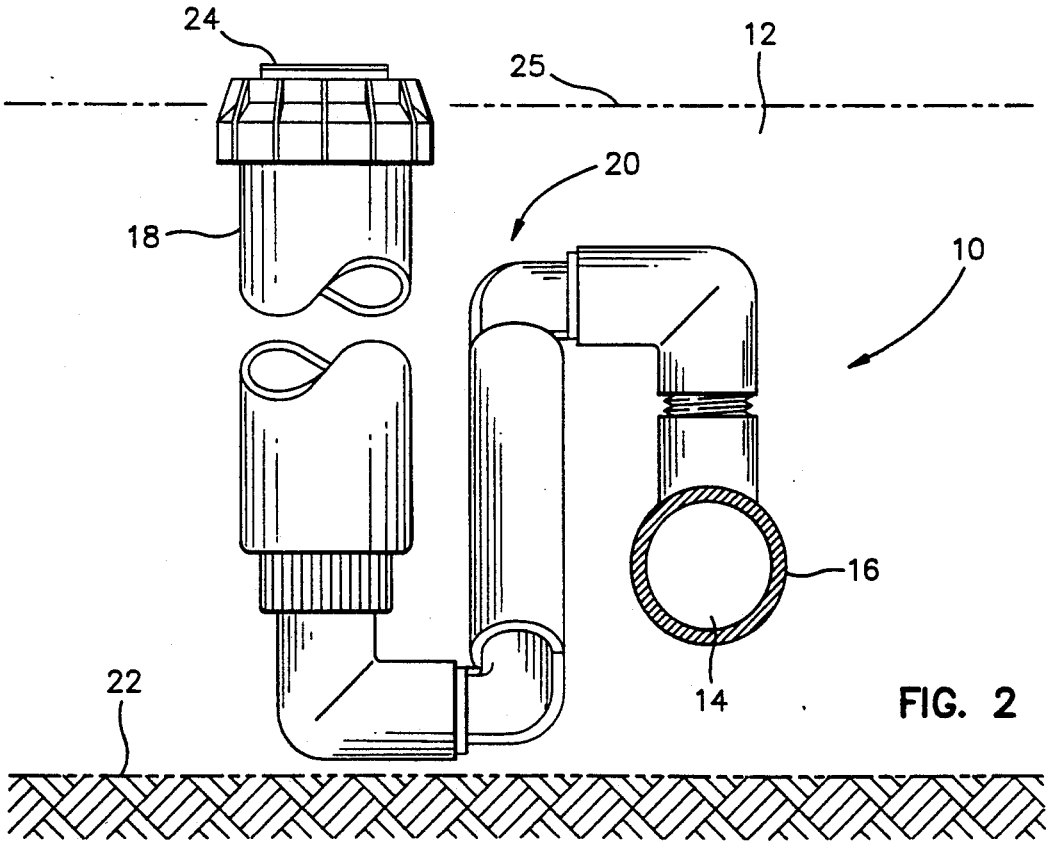
FIG. 2 is a front elevation view showing the unit in place beneath the surface of the ground and in the retracted position.

As shown in FIGS. 1 and 2, the swing connector 20 is connected to the top of the supply line 16 and extends to a position adjacent thereto. It is arranged to swing about a horizontal axis to enable adjustment of the elevation of the sprinkler unit 18. The connection to the supply line may be at any selected position about the axis thereof.

Figures 3, 4, 5:
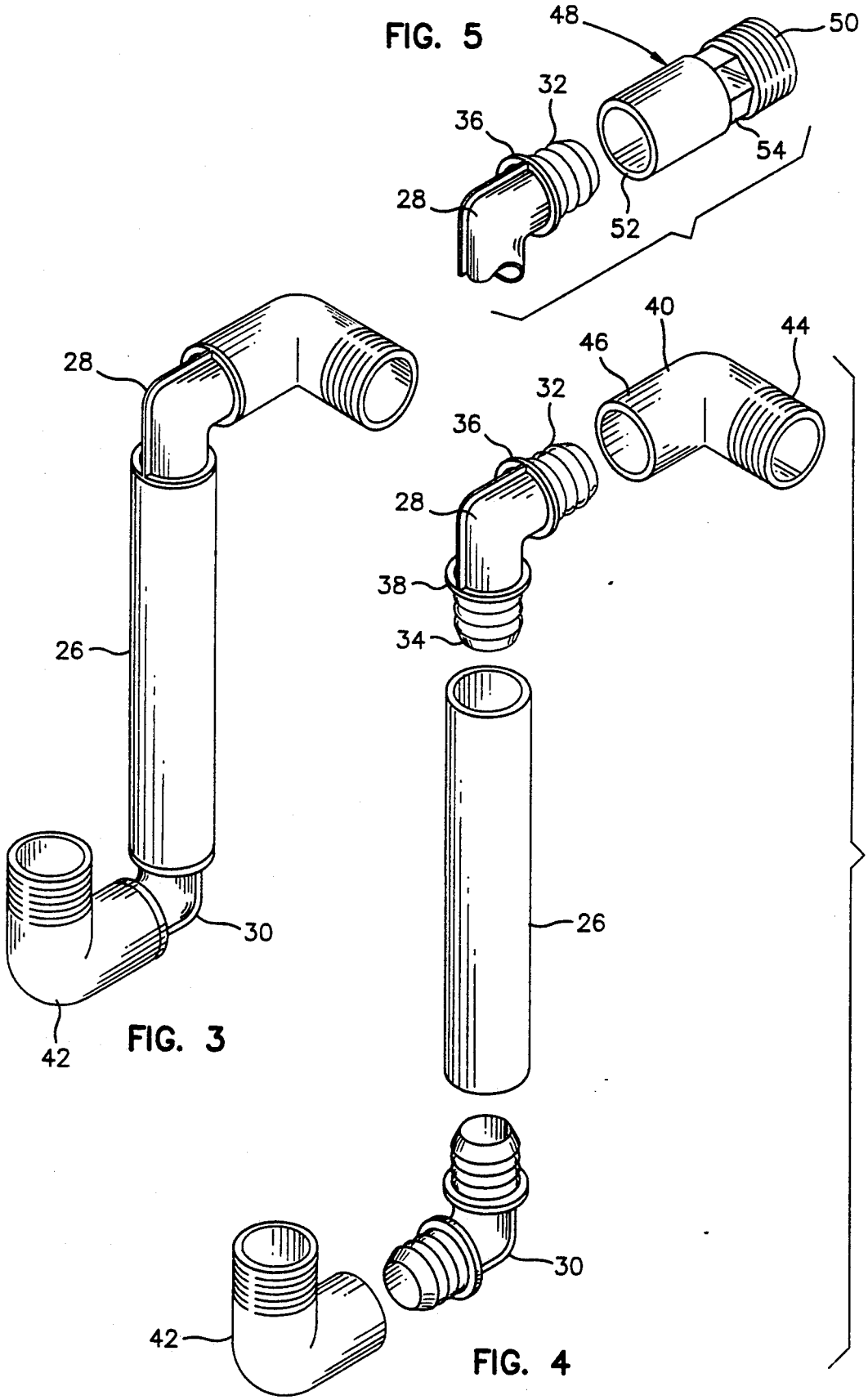
FIG. 3 is a perspective view showing an exemplary embodiment of a swing connector in accordance with a preferred embodiment of the invention.
FIG. 4 is an exploded view illustrating details of the components of the embodiment of FIG. 2.
FIG. 5 is an exploded partial view illustrating a modification of the embodiment of FIG. 4.

The swing connector unit, as will best be understood from FIGS. 3 and 4, is constructed to have three axes of rotation, which are mutually orthogonal. The swing connector unit, as illustrated in FIGS. 3 and 4, comprises an elongated central or intermediate conduit member 26 cut to a suitable length which may be according to the sprinkler unit height or housing length. This central conduit member is preferably of a slightly flexible or yieldable polyethylene pipe having a length of about one-half of the length of the sprinkler unit 18. A two axis swivel elbow 28 and 30 is connected to each end thereof. This, as will be explained, gives it the adjustability of the full length of the housing height relative to a supply line.

Referring to FIG. 4, at each end of the central conduit 26 is an intermediate barbed elbow 28 and 30. The barbed elbows are identical and only elbow 28 will be explained in detail. The elbow is constructed as shown in FIG. 4 to have a short length of what is generally referred to as a barbed fitting 32 and 34 at each end thereof. Abutting shoulders 36 and 38 provide stops when engaging the end of a pipe or fitting into which it is forced.

The barbed fitting is formed of a plurality of ramp type annular grooves forming a series of sharp annular edges extending away from the open end. The barbed fitting is designed for flexible or elastically yieldable pipe, such that when it is forced (press fitted) into the end of the pipe, the pipe expands to accommodate the fitting, and retracts or shrinks around the barbs of the fitting, forming a sealed rotatable connection. The connector and pipe are thereby locked into essentially a permanent connection. The fittings can be rotated relative to a pipe and one another, and unlike threaded connections will maintain a good sealed connection, and will not normally develop leaks.

These barbed elbows 28 and 30 each have one end that extends into the respective ends of the central conduit 26, and another end that extends into a non-threaded end of a pair of outer or end elbows 40 and 42. The elbows 40 and 42 are identical, with elbow 40 being described in detail and having a threaded end 44 and a non-threaded end 46. The end elbow is formed of HD polyethylene and serves to receive the barbed connector at one end and as a threaded connector to the supply line and sprinkler. The barbed end 32 of the elbow 28 extends and connects into the non-threaded end 46 of the elbow 40. This forms essentially a permanent connection that can freely rotate about its axis and maintain a seal.

From the above description, it is seen that the unit comprises a central conduit member 26, with an intermediate swivel elbow 28 and 30 connected to each end thereof, and an end swivel elbow 40 and 42 connected to each of the intermediate elbows. This provides a unit wherein the connector ends each may rotate about the axis of the central conduit 26, as well as an axis that is orthogonal to the central axis thereof. Thus, the overall unit provides for rotation about three mutually orthogonal axes. The threaded end of one end elbow can be threadably connected to the top, bottom or either side of a supply line. This enables a three-hundred sixty degree rotation or swing of the central tube 26 about a vertical or horizontal axis.

Referring to FIG. 5, there is illustrated an alternative connector for connection to the supply line of the sprinkler system. This alternate connector is an alternative to one of the elbows 40 and comprises a straight connector unit 48 having a threaded end 50, a non-threaded end 52 and a wrench flat or hexagonal intermediate section 54. The wrench section enables the application of torque to the fitting by means of a wrench. This unit in substitution for an elbow 40 provides the same number of rotative axis as an alternative unit but with one less elbow. This provides essentially the equivalent adjustment, with maybe minor restrictions on the orientation of the swing axis relative to connection to the main supply line. However, it does provide easier direct connection for certain confined spaces in that only the connector 48 need be rotated for establishing the connection.

In operation, as illustrated in FIG. 1, a trench 12 is formed for receiving a supply line 16 and having a bottom 14 on which rests the supply line 16. The trench 12 has a certain depth, which may be substantially uniform or not. A sprinkler unit 18, with a swing connector assembly 20, is selected with either an elbow or straight fitting. If only height adjustment is desired, an elbow fitting may be selected and the threaded end 44 of elbow 40 is threaded into an outlet to the supply line 16. The elbow may be threaded in a top or vertically upwardly oriented threaded connector as shown. The end 46 of the elbow 40 is oriented transverse to the supply line, such that one pivot or swivel axis runs transverse to the axis of the supply line 16, and the central conduit 26 swings about that axis, i.e. in a vertical plane.

As shown in FIGS. 1, and 2, the sprinkler unit is then adjustable in height up to twice the length of the central conduit 26. It is also adjustable along the axis of the supply line an amount up to twice the length of the central conduit unit. Thus, many different attachment orientations may be made to the supply line to obtain either a predominately vertical adjustment of the sprinkler unit or lateral adjustments, either along the supply line or around an arc to either side of the supply line at a given height. Thus, height and/or lateral adjustment may be made.

While we have illustrated and described our invention by means of specific embodiments, it is to be understood that numerous changes and modifications may be made therein without departing from the spirit and scope of the invention as defined in the appended claims.

We claim:

1. A swing connector assembly for connecting and positioning sprinkler units relative to supply lines, comprising:

an elongated central conduit for connecting between a supply line and a sprinkler unit;

a first swivel connector assembly having a barbed fitting connected to one end of said central conduit for connecting one end of said central conduit to one of a supply line and a sprinkler unit, said first swivel connector assembly being freely rotatable about the longitudinal axis of said central conduit; and a second swivel connector assembly having a barbed fitting connected to the other end of said central conduit for connecting said other end of said central conduit to the other one of supply line and a sprinkler unit, said second connector assembly being freely rotatable about the longitudinal axis of said central conduit, and wherein at least one of said first and second swivel connector assemblies includes a portion which is freely rotatable about an axis orthogonal to the longitudinal axis of said central conduit.

2. The swing connector assembly according to claim 1 wherein said central conduit is of sufficient length to position the outlet of a sprinkler unit a distance of from one-half the length of said sprinkler unit to about one and one-half its length from the connection to the supply line.

3. The swing connector assembly according to claim 2 wherein each of said first and second connector assemblies include a portion which is rotatable about an axis orthogonal to the longitudinal axis of said central conduit.

4. The swing connector assembly according to claim 3 wherein each of said first and second connector assemblies includes a pair of elbows that are freely rotatable relative to one another.

5. The swing connector assembly according to claim 1 wherein both of said first and second connector assemblies include a portion which is rotatable about an axis orthogonal to the longitudinal axis of said central conduit.

6. The swing connector assembly according to claim 5 wherein each of said first and second connector assemblies include a pair of elbows, wherein one elbow of each pair includes a barbed fitting on each end.

7. The swing connector assembly according to claim 1 wherein said central conduit is at least one-half the length of the sprinkler unit, and the first and second connector assemblies enable a sprinkler unit to rotate about three mutually orthogonal axes.

8. The swing connector assembly according to claim 7 wherein said first and second connector assemblies each includes a pair of elbows, and one elbow of each pair is freely rotatable about both axes thereof.

9. The swing connector assembly according to claim 1 wherein said first and second connector assemblies each includes an inner elbow and an outer elbow, and the outer elbow is threaded at the outer end thereof, and the inner elbow is freely rotatable about both axes thereof.

10. The swing connector assembly according to claim 9 wherein each said inner elbow has a barb connector at each end thereof.

11. A swing connector for accommodating variations in the positioning of sprinkler units relative to a water supply line, comprising:

an elongated substantially straight central conduit for connecting between a supply line and a sprinkler unit;

a first swivel connector assembly including a first intermediate elbow connected by a barbed fitting to one end of and rotatable about the axis of said central conduit, a first outer threaded member connected at one end to said first intermediate elbow for connecting said one end of said central conduit to one of a supply line and a sprinkler unit, said first swivel connector assembly being freely rotatable about the longitudinal axis of said central conduit; and a second swivel connector assembly including a second intermediate elbow mounted by a barbed fitting on the other end of said central conduit, and a second threaded outer member for connecting said other end of said central conduit to the other one of a supply line and a sprinkler unit, said second swivel connector assembly being freely rotatable about the longitudinal axis of said central conduit, and wherein at least one of said first and second threaded outer member is freely rotatable about an axis orthogonal to the axis of said central conduit.

12. The swing connector assembly according to claim 11 wherein both of said first and second threaded outer members are rotatable about an axis orthogonal to the longitudinal axis of said central conduit.

13. The swing connector assembly according to claim 13 wherein both of said first and second threaded outer members are elbows.

14. The swing connector assembly according to claim 12 wherein said central conduit is at least one-half the length of the sprinkler unit, and the first and second connector assemblies enable a sprinkler unit to rotate about three mutually orthogonal axes.

15. The swing connector assembly according to claim 12 wherein said first and second swivel connector assemblies each includes a respective one of said intermediate elbow and an outer elbow, and the inner elbow is rotatably connected at one end to said central conduit and at the other end to the outer elbow, and the outer elbow is threaded at the outer end thereof.

16. The swing connector assembly according to claim 15 wherein said central conduit is flexible, and the intermediate elbow is connected to both the central conduit and the outer elbow by means of a barb connection.

17. The swing connector assembly according to claim 16 wherein said central conduit is at least one-half the length of the sprinkler unit, and the first and second connector assemblies enable said sprinkler unit to rotate about three mutually orthogonal axes.

18. The swing connector assembly according to claim 15 wherein said central conduit is at least one-half the length of the sprinkler unit, and the first and second connector assemblies enable said sprinkler unit to rotate about three mutually orthogonal axes.

19. A method of installing a pop-up sprinkler unit at a selected level relative to the height of supply lines, comprising:

selecting an elongated central conduit for connecting between a connection to a supply line and a sprinkler unit;

selecting a first swivel connector assembly including an inner elbow having a barbed fitting and mounting said inner elbow of said first swivel assembly on one end of said central conduit for connecting said one end of said central conduit to one of a supply line and a sprinkler unit, said first swivel connector assembly being freely rotatable about the longitudinal axis of said central conduit;

selecting a second swivel connector assembly including an inner elbow having a barbed fitting and mounting said inner elbow of said second swivel assembly on the other end of said central conduit for connecting said other end of said central conduit to the other one of a supply line and a sprinkler unit, said second swivel connector assembly being freely rotatable about the longitudinal axis of said central conduit, and wherein at lest one of said first and second swivel connector assemblies includes a portion which is rotatable about an axis orthogonal to the longitudinal axis of said central conduit;

connecting one of said first and second swivel connector assemblies to a supply line and connecting the other of said first and second swivel connector assemblies to an inlet of a sprinkler unit; and positioning the outlet of said sprinkler unit at said selected level.

20. The method of installing a sprinkler unit according to claim 19 wherein said first and second swivel connector assemblies are each selected to include said inner elbow and an outer elbow, and the inner elbow is rotatably connected at one end to said central conduit and at the other end to the outer elbow, and the outer elbow is threaded at the outer end thereof; and wherein said central conduit is selected to be flexible and the inner elbow is connected to both of the central conduit and the outer elbow by means of a barb connection.

* * * * *